United States Patent [19]

Fildan

[11] Patent Number: 4,848,813

[45] Date of Patent: Jul. 18, 1989

[54] DOOR-BOLT ASSEMBLY

[76] Inventor: Gerhard Fildan, Dieselstr. 20, D-7250 Leonberg, Fed. Rep. of Germany

[21] Appl. No.: 112,750

[22] Filed: Oct. 22, 1987

[30] Foreign Application Priority Data

Oct. 23, 1986 [DE] Fed. Rep. of Germany ... 8628209[U]

[51] Int. Cl.[4] ..... E05C 1/16

[52] U.S. Cl. ..... 292/167; 292/171; 292/337

[58] Field of Search ..... 292/171, 173, 141, 167, 292/84, 28, 50, 38, 225, 235, 125, 133, DIG. 38, 337, DIG. 62, 356, 336.5, 169.5–169.8, 168, 169

[56] References Cited

U.S. PATENT DOCUMENTS

| | | | |
|---|---|---|---|
| 107,578 | 9/1870 | Williams | 292/167 |
| 238,627 | 3/1881 | Wolfroth | 292/167 |
| 1,030,313 | 6/1912 | Markley | 292/167 |
| 1,653,512 | 12/1927 | Schlage | 292/356 |
| 1,744,457 | 1/1930 | Ellingson | 292/DIG. 62 |
| 3,179,459 | 4/1965 | Lint | 292/356 |
| 3,829,137 | 8/1974 | MacDonald | 292/171 |
| 3,853,341 | 12/1974 | MacDonald | 292/171 |
| 4,012,066 | 3/1977 | Salvatore | 292/38 |
| 4,109,948 | 8/1978 | Potter et al. | 292/336.5 |
| 4,650,229 | 3/1987 | Bardfeld | 292/167 |
| 4,662,666 | 5/1987 | Wimmer | 292/337 |
| 4,691,951 | 9/1987 | Fildan | 292/DIG. 60 |

FOREIGN PATENT DOCUMENTS

| | | | |
|---|---|---|---|
| 145472 | 4/1936 | Austria | 292/171 |
| 42464 | 2/1888 | Fed. Rep. of Germany | 292/167 |
| 12499 | 10/1956 | Fed. Rep. of Germany | 292/171 |
| 1018745 | 10/1957 | Fed. Rep. of Germany | 292/171 |
| 662916 | 3/1929 | France | 292/171 |
| 136804 | 7/1952 | Sweden | 292/167 |
| 247400 | 12/1947 | Switzerland | 292/167 |
| 21490 | of 1906 | United Kingdom | 292/167 |
| 305419 | 2/1929 | United Kingdom | 292/167 |

*Primary Examiner*—Gary L. Smith
*Assistant Examiner*—Eric K. Nicholson
*Attorney, Agent, or Firm*—Herbert Dubno

[57] ABSTRACT

A door-bolt assembly for a door set has a stud having a pair of arms which engage respective eccentric rods coupling the doorknobs together so that one of these arms is effective to retract the door bolt in one sense of rotation of the doorknobs while the other arm is rendered ineffective and vice versa.

3 Claims, 4 Drawing Sheets

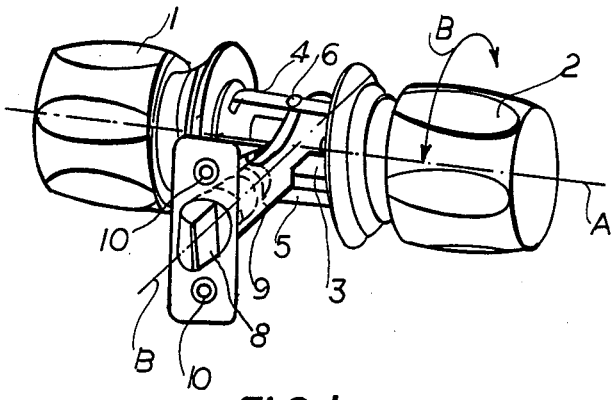
FIG. 1
FIG. 2
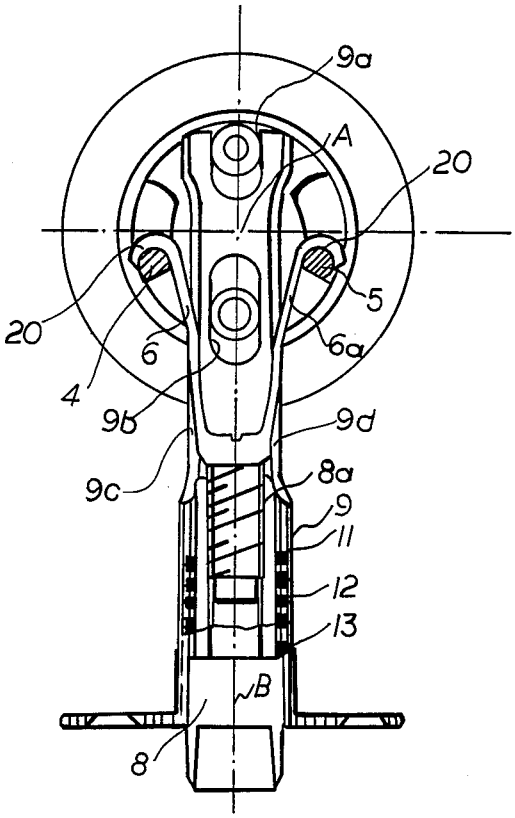

DOOR-BOLT ASSEMBLY

FIELD OF THE INVENTION

My present invention relates to a door-bolt assembly and, more particularly, to an assembly of the type in which a door bolt is displaced by rotation of the doorknob of the door set to retract the bolt in a housing against a spring force.

BACKGROUND OF THE INVENTION

In my U.S. Pat. No. 4,691,951, I have described a door set of a type having a pair of doorknobs which are coupled together by a pair of diametrically opposite rods which are eccentric to the axis of rotation of the doorknobs. A hook of the door bolt engages one of these rods, the door bolt being biased outwardly by a coil spring in a housing, casing or sleeve which is affixed in the edge of the door so that the bolt can emerge to engage a stroke on the door jamb. When one of the doorknobs is rotated, the bolt is retracted allowing the door to open.

To permit adjustment, the bolt is formed in two parts which are connected by a screw coupling, namely a stud formed with an external thread which is provided with the hook and the engagement portion of the bolt which is internally threaded to threadedly engage this stud.

A similar structure is illustrated in German Utility Model DE-GM No. 85 29 711.

It will be apparent from the aforementioned patent and Utility Model, that the hook on the single arm of the stud, in engagement with the eccentric rod, creates a preferred opening direction for the knob rotation, i.e. when either knob is rotated in the sense that the engaged rod retracts the bolt, the bolt will be withdrawn from the strike in an appropriate manner.

However, rotation in the opposite sense may pose a problem since the rod may leave the hook in the case where the hook is open. Of course it is possible in that situation to provide the knob so that it cannot rotate in the undesired sense, but this poses a constraint on the door set which may be undesirable.

It is, therefore, frequently advantageous to provide the door set so that the bolt can be retracted in the bolt housing in either sense of rotation of either knob. This presents a simplification of operation and allows the door set to be better utilized by the elderly, the disabled or in emergency situations as is required by law in many countries.

OBJECTS OF THE INVENTION

It is the principal object of the present invention to provide a door-bolt assembly which can have these last-mentioned advantages and, more particularly, can be operated with ease in either sense of rotation without difficulty.

Another object of this invention is to provide an improved door set having the advantages of the aforementioned patent but better able to permit door-opening operation by rotation of either knob of the door set in either sense.

SUMMARY OF THE INVENTION

These objects and others which will become apparent hereinafter, are attained, in accordance with the invention, in a door-bolt assembly for a door set having at least one doorknob provided with diametrically opposite pins or rods eccentric with respect to an axis of rotation of the doorknob, this assembly comprising a tubular lock-bolt housing adapted to be mounted in an edge of a door, a door bolt guided in the housing and screwed onto a stud having a body formed with a screw thread and, at one end thereof, a pair of spring arms reaching away from the body symmetrically with respect to an axis thereof. Each of these arms can be provided with means engageable with a respective one of the pins, arms being deflected toward and away form one another to permit one of the arms selectively to be pulled to retract the bolt into the housing while the other arm is rendered ineffective by releases of the hook or a folding or bending action depending upon the rotation of the knob.

A coil spring in the housing acts upon the stud to bias the bolt outwardly. The means, engageable with a respective, pin can be a hook open in the direction opposite that in which the arm is pulled by the respective pin or a closed eye through which the pin or rod is passed. In either case herein, the open hook and the eye, which can be considered a closed hook, may be referred to as a hook for convenience and hence whenever the word "hook" is used hereinafter, it will be understood that it can mean an open hook in the sense described above or a closed hook or eye.

The two spring arms with other respective hooks thus form a double-hook arrangement which impart a symmetrical fork-like configuration to the aforementioned end of the stud and each of the hooks can engage one of the two diametrically opposite eccentric rods.

Depending upon the sense of rotation, however, one or the other hooks of the double-hook arrangement will be pulled or rendered effective while the other hook is rendered ineffective.

In the preferred state, this is achieved by pushing the rod out of the other hook or folding or bending the other arm so that it is ineffective. Of course, under the spring action, the bolt returns to its original position to draw the knob back into its centered position in which the other rod reengages the other hook or the bend or fold in the other arm is opened to permit the other arm to extend into its normal position.

Of course, the rods or pins need not lie diametrically opposite one another, as long as they are generally symmetrical about the axis of the bolt assembly in the normal or nonrotated position of the knob.

The bending or folding of the arm which is ineffective can be provided by forming both of the arms with means defining a plurality of spaced-apart articulations along the length thereof, the articulations being preferably provided by so-called one-piece hinges defined by lateral indentations or notches. Each of the arms can be formed with at least two indentations on a side of the arm turned outwardly from the axis of the body over a portion of a length of the arm proximal to the body to induce inward deflection of this portion. At least two further indentations are provided on a side of each arm turned inwardly toward the axis over a portion of the length of the arm distal from the body to induce an outward deflection of the distal portion upon displacement of the respective eye toward the body by the respective pin or rod upon rotation thereof.

BRIEF DESCRIPTION OF THE DRAWING

The above and other objects, features and advantages of the present invention will become more readily apparent from the following description, reference being made to the accompanying drawing in which:

FIG. 1 is a simplified perspective view of a door set embodying a door-bolt assembly of the present invention in which only one spring arm is visible, the other spring arm being concealed by the body of the stud;

FIG. 2 is a cross-sectional view through the rods and the door bolt showing the stud body and the spring arms thereof in elevation and in a nonrotated position of the doorknobs;

SPECIFIC DESCRIPTION

Figure 3:
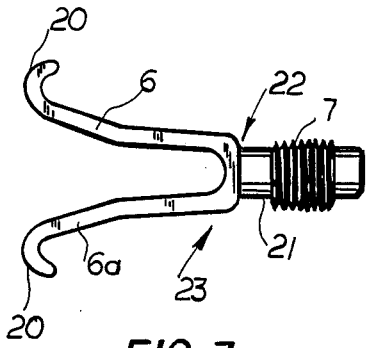
FIG. 3 is a view of the stud and spring arms of FIG. 2.
Figure 4:
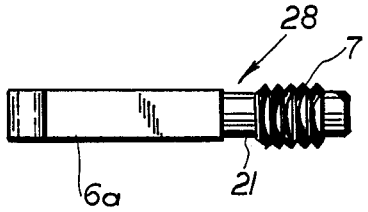
FIG. 4 is a view of the structure of FIG. 3 taken in a plane at a right angle to view of FIG. 3.

FIG. 1 shows a door set comprising doorknobs 1 and 2 (see U.S. Pat. No. 4,691,951) which can be mounted on opposite sides of a door (now shown) so that they can rotate about an axis A in either of two senses as represented by the arrow B. Guide bolts 3 connecting the two knob assemblies and via slots 9*a* and 9*b* (see the aforementioned patent). The doorknob assembly is connected to a bolt housing 9.

The two knobs are also connected together by pins 4 and 5 which are eccentric with respect to the axis A and are disposed symmetrically about the axis B of the bolt housing.

The rods 4 and 5 are engaged by respective hooks 20 of two spring arms 6, 6*a* integral at one end with the body 21 of a stud 22 formed with a screw thread 7 threaded into the female threaded portion of the door bolt 8. By rotation of the door bolt 8 relative to the stud in one or another direction, the effective length of the door bolt can be adjusted as described in the patent. The female thread has been represented at 8*a* in FIG. 2.

The door bolt and stud are axially shiftable along the bolt housing 9 which has slots 9*c* and 9*d* through which the arms 6 and 6*a* emerge.

Screws represented at 10 in FIG. 1 can affix the flanges of the bolt housing 9 to the door edge in the usual manner.

The bolt housing 9 is formed with a seat or shoulder 11 against which a coil spring 12 can bear, the coil spring likewise bearing against a shoulder 13 of the bolt 8 which is threadedly coupled with the stud 22 by the thread 7. The coil spring may be under prestress so that a force is applied in the outward direction to the bolt 8, holding the hooks 20 against the rods 4 and 5.

If the knobs 1 and 2 are rotated in one sense, say the clockwise sense in FIG. 2, the rod 4 will draw the bolt 8 inwardly to retract the bolt while the rod 5 will pass out of the hook 20 of the arm 6*a* and the door can be opened. The spring is compressed further and, upon release of the doorknob, biases the bolt outwardly to restore the position shown in FIG. 2, the rod 5 having reentered the hook 20 of arm 6*a*. Upon rotation of the knobs in the opposite sense, arm 6*a* will be pulled by the rod 5 and rod 4 released from the hook 20 of arm 6 so as to make this arm ineffective.

The arms 6 and 6*a* provide a fork-shaped extremity 23 on the stud 22 which is symmetrical with respect to the axis B.

In FIGS. 5–9, I have shown other constructions of the arms of the stud. For example, in FIG. 5, I have shown a stud 122 with arms 106, 106*a* formed at their free extremities with eyes 120 which can be considered closed hooks and are traversed by the respective rods (not shown). The arm 106 is notched at 106′ and 106″ as will be described in greater detail with reference to FIGS. 7–9 to permit this arm to fold when it is to be ineffective. The arm 106*a* is of thin-walled construction to permit bending when this arm is not to interfere with the pulling action on the other arm.

Figure 6:
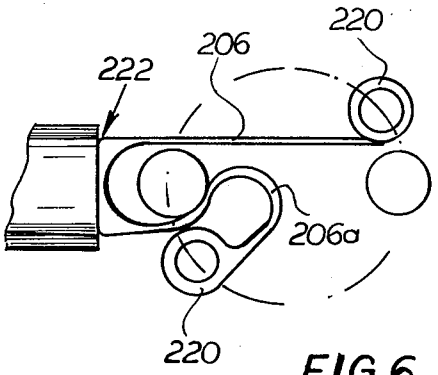
FIG. 6 is an illustration of still another arm arrangement represented as the doorknob had been rotated in the clockwise sense.
Figure 5:
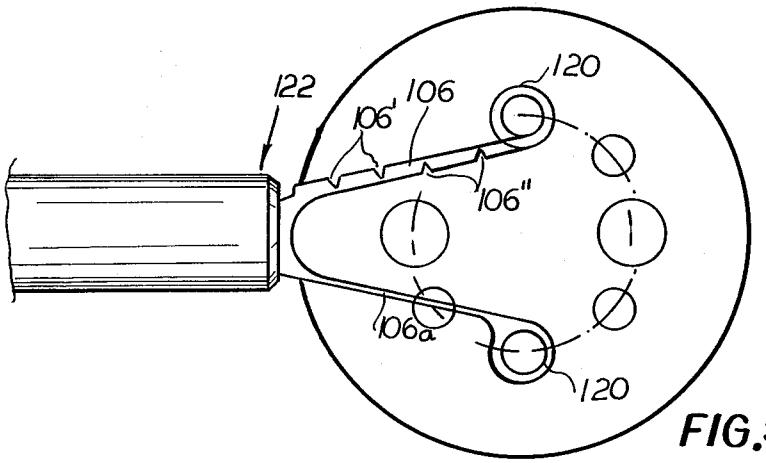
FIG. 5 is a diagram showing another embodiment of the spring arms of the invention.
Figure 7:
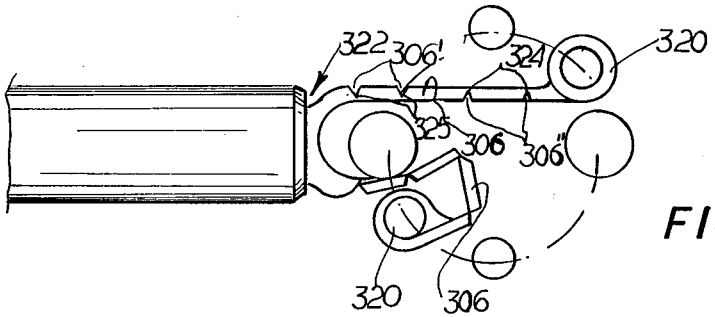
FIG. 7 is a view similar to FIG. 6 of another embodiment.
Figure 8:
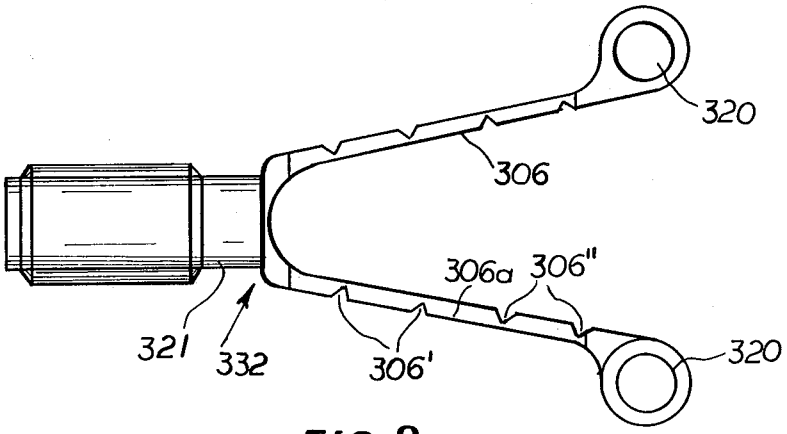
FIG. 8 is a view similar to FIG. 3 of the embodiment of FIG. 7.
Figure 9:
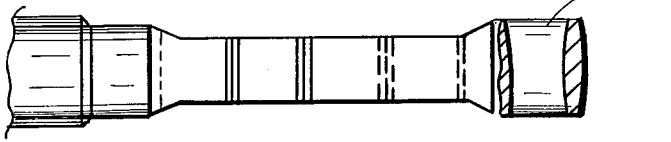
FIG. 9 is a side elevational view, partly broken away of the bolt member shown in FIG. 8.

Turning now to FIG. 6, in which a stud 222 is diagrammatically shown, it can be seen that each arm 206, 206*a* of this stud is of the thin type mentioned for the arm 106*a* and is formed with a respective eye 220 engageable with a respective rod. In the diagram illustrated in FIG. 6, rotation of the doorknobs in the clockwise sense will cause the arm 206 to pull the stud 222 and hence the bolt connected therewith to the right, while the highly flexible character of the arms will permit the other arm 206*a* to bend without impending rotation of the knobs. Of course, when the knobs are released, the bolt is pulled to the left and the bend opens up. Rotation of the knob in the opposite sense will apply direction to the bolt via the arm 206*a* and cause the arm 206 to bend. In FIGS. 7–9, the stud 322 has arms 306, 306*a* with the eyes 322 to fold about articulations or hinge joints 324 and 325 formed by notches 306′ and 306″, respectively. These hinges are formed integrally by the material of the arms and may be so-called film hinges.

Two such notches are provided over a portion of each arm proximal to the body 321 of the stud and the other two notches 306″ are provided over a portion of the arm distal to the body of the stud. As a consequence, when the eye of one of the arms is moved closer to the body as shown for the arm 306*a* in FIG. 7, there will be folding or opening about the articulations with the proximal portion bending toward the axis and the distal portion bending away from the axis.

Otherwise the device of FIGS. 7 and 9 operate in the same manner as the device described in connection with FIG. 6.

The stud and its arms can be formed unitarily by injection molding from a thermoplastic synthetic resin material.

I claim:

1. A door set, comprising:

a pair of door knobs adapted to be mounted on a door for conjoint rotation about a common axis, said door knobs having diametrically opposite pins eccentric with respect to said common axis; and a door-bolt assembly operated by said door knobs, said assembly comprising:

a tubular lock-bolt housing adapted to be mounted in said door, a door bolt guided in said housing, a lock-bolt stud having a body formed with a screw thread and at an end of said body with a pair of spring arms diverging from said body symmetrically with respect to an axis of said body perpendicular to said common axis, said door bolt being screwed onto said screw thread, each of said arms being provided with coupling means engageable with a respective one of said pins, said arms being formed with spaced apart indentations along the lengths of the respective arms, a pair of said indentations being formed on a side of the respective arm turned away from said axis of said body over a portion of the length of the respective arm proximal to said body to induce an inward deflection of said portion, each of indentations being formed with two flanks converging toward said axis of said body, and another pair of the indentations on an opposite side over another portion of the length of the respective arm to induce an outward deflection of said another portion distal from said body, each of the indentations of the other pair having two flanks diverging from said axis of said body toward said opposite side, so that said flanks of each of the indentations of the respective pair engage each other upon displacement of the respective coupling means toward said body by the respective pin upon rotation of said door knobs in opposite senses limiting a deflection of said arms toward said axis of the body, said deflection being sufficient to permit one of said arms selectively to be pulled to retract said bolt into said housing while the other of said arms is ineffective depending upon the direction of rotation of said knobs, said door bolt being screwed into said screw thread, and a coil spring in said housing braced against said housing and acting upon said stud to bias said bolt outwardly from said housing and resist the pull on the selected one of said arms.

2. The door set defined in claim 1 wherein said means engageable with a respective one of said pins on each of said arms is a hook open in the direction opposite that in which the respective arm is pulled by the respective pin.

3. The door set defined in claim 1 wherein said means engageable with a respective one of said pins on each of said arms is a closed eye formed on the respective arm.

* * * * *